US007976126B2

(12) United States Patent
Hirai

(10) Patent No.: US 7,976,126 B2
(45) Date of Patent: Jul. 12, 2011

(54) LIQUID JET HEAD, LINE TYPE LIQUID JET HEAD, PRINTER, LINE TYPE PRINTER AND FILM FORMING APPARATUS

(75) Inventor: Eiju Hirai, Fujimi (JP)

(73) Assignee: Seiko Epson Corporation (JP)

( * ) Notice: Subject to any disclaimer, the term of this patent is extended or adjusted under 35 U.S.C. 154(b) by 325 days.

(21) Appl. No.: 12/342,480

(22) Filed: Dec. 23, 2008

(65) Prior Publication Data

US 2009/0160906 A1 Jun. 25, 2009

(30) Foreign Application Priority Data

Dec. 25, 2007 (JP) ..... 2007-331662
Nov. 13, 2008 (JP) ..... 2008-291163

(51) Int. Cl.
*B41J 2/14* (2006.01)
*B41J 2/16* (2006.01)
*B41J 2/045* (2006.01)

(52) U.S. Cl. ..... 347/48; 347/40; 347/44; 347/47; 347/54; 347/68; 347/69; 347/71

(58) Field of Classification Search ..... 347/45, 347/68, 69, 71
See application file for complete search history.

(56) References Cited

U.S. PATENT DOCUMENTS 4,703,333 A * 10/1987 Hubbard ..... 347/40
2005/0001877 A1 * 1/2005 Chikanawa et al. ..... 347/42

FOREIGN PATENT DOCUMENTS

JP 2007-144867 6/2007

* cited by examiner

*Primary Examiner* — Ryan Lepisto
(74) *Attorney, Agent, or Firm* — Harness, Dickey & Pierce, P.L.C.

(57) ABSTRACT

A liquid jet head includes: a plurality of unit heads, wherein each of the unit heads has a nozzle forming region and a plurality of nozzle apertures arranged in a first direction in the nozzle forming region, the plurality of unit heads being laminated in a manner that the nozzle forming regions are shifted from one another in a second direction orthogonal to the first direction, wherein the unit heads are laminated in a third direction orthogonal to the first direction and the second direction, and liquid is ejected in a fourth direction between the second direction and the third direction.

11 Claims, 11 Drawing Sheets

LIQUID JET HEAD, LINE TYPE LIQUID JET HEAD, PRINTER, LINE TYPE PRINTER AND FILM FORMING APPARATUS

This application claims a priority to Japanese Patent Application No. 2007-331662 filed on Dec. 25, 2007 and No. 2008-291163 filed on Nov. 13, 2008 which are hereby expressly incorporated by reference herein in its entirety.

BACKGROUND

1. Technical Field

The present invention relates to liquid jet heads, line type liquid jet heads, printers, line type printers and film forming apparatuses.

2. Related Art

Liquid jet heads may be used, in addition to ordinary printing, in film forming apparatuses used in the steps of forming patterns in semiconductor devices, and forming color filters in manufacturing liquid crystal displays, plasma displays, organic EL displays and electrophoretic displays, and in the steps of forming patterns of light emission layers and the like on substrates. Such apparatuses are equipped with a mechanism that controls the nozzles to eject liquid at target positions while changing relative positions between a medium and the liquid jet head. One of the performances required for a liquid jet head is the accuracy in coating position of liquid when the liquid is coated on a medium. In order to coat liquid on a medium with high positional accuracy, accurate operation mechanisms and high assembly accuracy are required. The larger a pattern area to be formed, the more severe the requirement becomes. The apparatus described above is generally equipped with a liquid jet head having a plurality of rows of regularly arranged nozzles for high-speed printing.

A liquid jet head in related art may have a structure that includes a plurality of nozzle rows each having a plurality of regularly arranged nozzles, wherein the nozzle rows may eject, for example, inks in different colors, respectively. However, the plurality of nozzle rows in related art are arranged in a plane, and therefore the nozzle rows need to be arranged at relatively large intervals because the ink flow passages and the driving mechanism for ink ejection are relatively large in size. Therefore, when inks in multiple colors need to be coated at specified target positions on a medium, the medium or the nozzles need to be accurately moved in a relatively long distance to the target positions, which requires the apparatus to have extremely high mechanical precision. Also, inks ejected from specified ones of the nozzles and coated at target positions on a medium may cause deformation in the medium before the other ones of the nozzles reach the target positions, and errors caused by such deformation need to be considered.

To address the problems described above, there has been proposed a method of feedback controlling the positional shift and liquid ejection in order to improve the accuracy in coating positions. Japanese Laid-open Patent Application JP-A-2007-144867 is an example of related art. However, according to this method, it is expected that the faster the coating operation, the more difficult the control becomes.

SUMMARY

In accordance with an advantage of some aspects of the invention, it is possible to provide a liquid jet head having a plurality of highly densely arranged nozzle apertures, with few deviations in liquid coating positions.

A liquid jet head in accordance with an embodiment of the invention includes: a plurality of unit heads, wherein each of the unit heads has a nozzle forming region and a plurality of nozzle apertures arranged in a first direction in the nozzle forming region, the plurality of unit heads are laminated in a manner that the nozzle forming regions are shifted from each other in a second direction orthogonal to the first direction, wherein the unit heads are laminated in a third direction orthogonal to the first direction and the second direction, and liquid is ejected in a fourth direction between the second direction and the third direction.

According to the liquid jet head described above, deviations in liquid coating positions can be reduced as the plurality of nozzle apertures are arranged with high density.

In the liquid jet head described above in accordance with an aspect of the invention, the nozzle apertures have center lines that may be inclined with respect to the third direction.

In the liquid jet head described above in accordance with an aspect of the invention, the nozzle apertures may be formed in a manner that center lines of the nozzle apertures are perpendicular to a plane that may be defined by connecting ends in the second direction of the head units.

In the liquid jet head described above in accordance with an aspect of the invention, the number of the unit heads is m (m is a natural number of 2 or higher), and the m unit heads may be laminated in a manner that the unit heads are shifted from one another in the first direction by an amount of n/m of the interval between adjacent ones of the nozzle apertures (n is a natural number less than m).

In the liquid jet head described above in accordance with an aspect of the invention, each of the unit heads includes a nozzle plate having a plurality of nozzle apertures arranged along the first direction in the nozzle forming region, a pressure chamber substrate provided above the nozzle plate and having a plurality of pressure chambers communicating with the nozzle apertures, an elastic plate provided above the pressure chamber substrate, a plurality of piezoelectric elements provided above the elastic plate and above the pressure chambers, respectively, each of the piezoelectric elements having a lower electrode, a piezoelectric layer and an upper electrode, and a sealing plate provided above the piezoelectric elements and covering the piezoelectric elements through a space there between.

In the liquid jet head described above in accordance with an aspect of the invention, the plurality of unit heads may eject mutually different liquids.

A line type liquid jet head in accordance with an embodiment of the invention includes a plurality of the liquid jet heads described above, wherein the plurality of the liquid jet heads are arranged in a staggered manner such that the fourth directions are aligned in the same direction, and the liquid jet heads are disposed in a manner that the nozzle forming regions are arranged next to each other.

According to the line type liquid jet head, deviations in liquid coating positions can be reduced as the plurality of nozzle apertures are arranged at high density.

In the line type liquid jet head in accordance with an aspect of the invention, the plurality of liquid jet heads are arranged in the first direction with overlapping regions provided therein, wherein the nozzle apertures of each of the liquid jet heads may be continuously arranged in the first direction across the plurality of liquid jet heads.

In the line type liquid jet head in accordance with an aspect of the invention, the pitch of the nozzle apertures in the entire line type liquid jet heads may be constant in the first direction.

A printer in accordance with an embodiment of the invention is equipped with any one of the liquid jet heads described above.

According to the printer described above, deviations in liquid coating positions can be reduced as the plurality of nozzle apertures are arranged with high density.

A line type printer in accordance with an embodiment of the invention is equipped with any one of the line type liquid jet heads described above.

According to the line type printer described above, deviations in liquid coating positions can be reduced as the plurality of nozzle apertures are arranged with high density.

A film forming apparatus in accordance with an embodiment of the invention includes any one of the liquid jet heads described above, or any one of the line type liquid jet heads described above.

According to the film forming apparatus described above, deviations in liquid coating positions can be reduced as the plurality of nozzle apertures are arranged with high density.

DESCRIPTION OF EXEMPLARY EMBODIMENTS

Preferred embodiments of the invention are described below. It is noted that the embodiments below are examples that describe the invention. In the embodiments described below, a direction X, a direction Y and a direction Z indicated by arrows in each of the figures are orthogonal to one another, and correspond to the first direction, the second direction and the third direction mentioned above, respectively. Also, in the embodiments to be described below, the first direction, the second direction and the third direction may be referred to simply as an X direction, a Y direction and a Z direction, respectively.

1. First Embodiment

1.1. Liquid Jet Head

Figure 1:
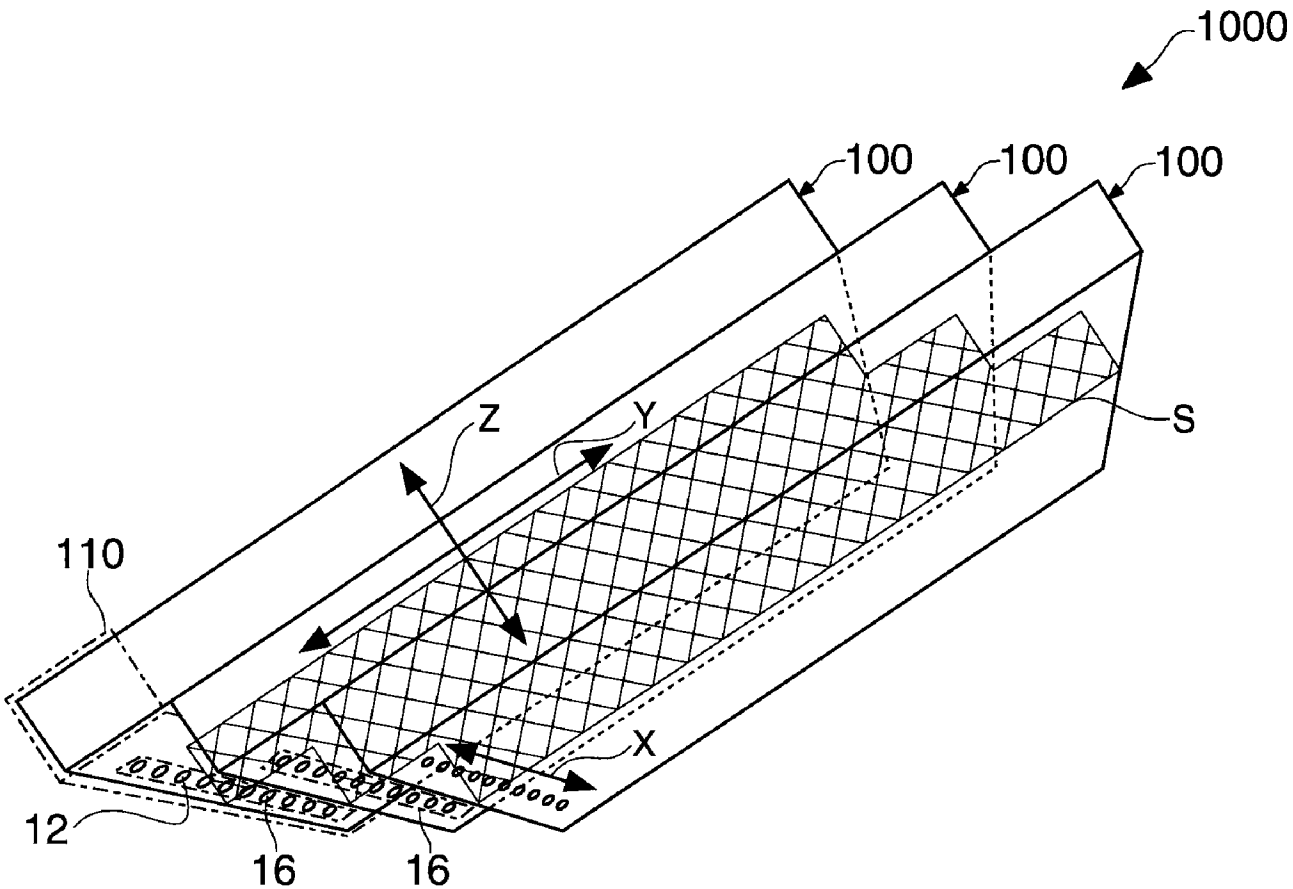
FIG. 1 is a schematic perspective view of a liquid jet head 1000 in accordance with an embodiment of the invention.
Figure 2:
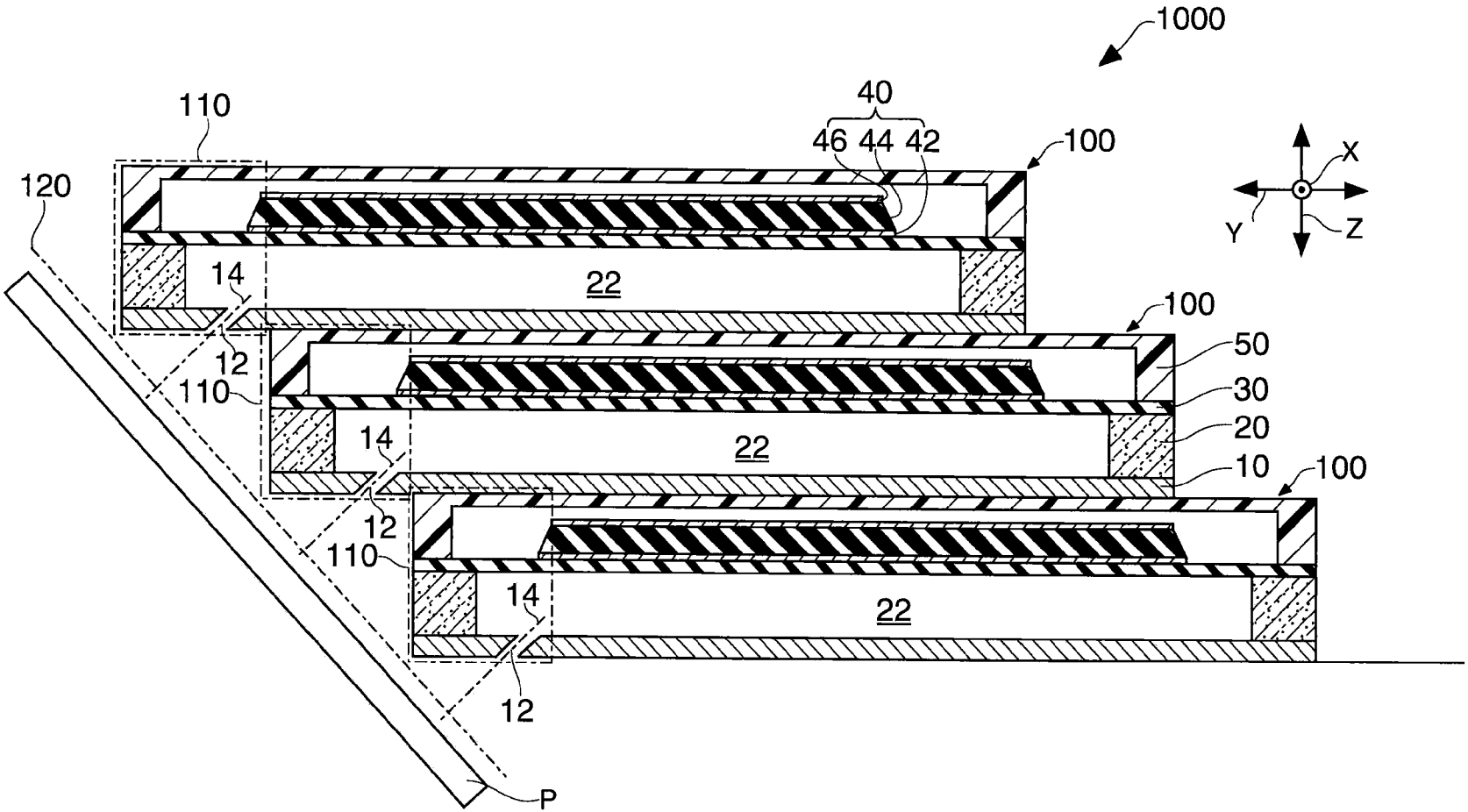
FIG. 2 is a schematic cross-sectional view of the liquid jet head 1000 in accordance with the present embodiment.
Figure 3:
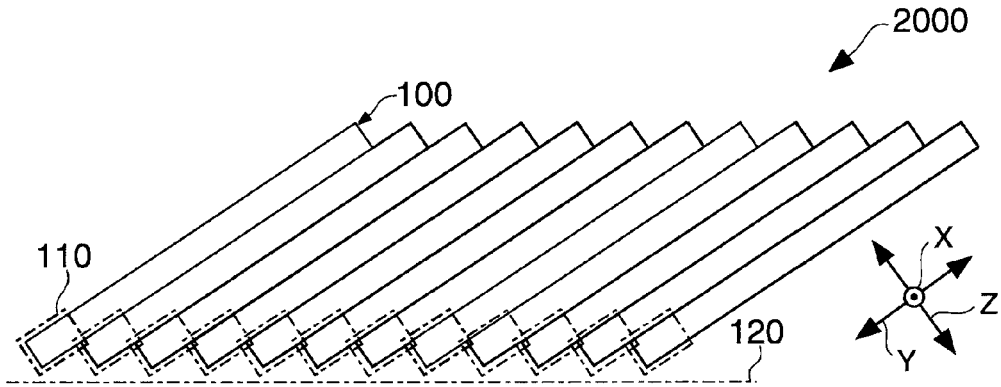
FIG. 3 is a schematic side view of a liquid jet head 2000 in accordance with an embodiment of the invention.
Figure 4:
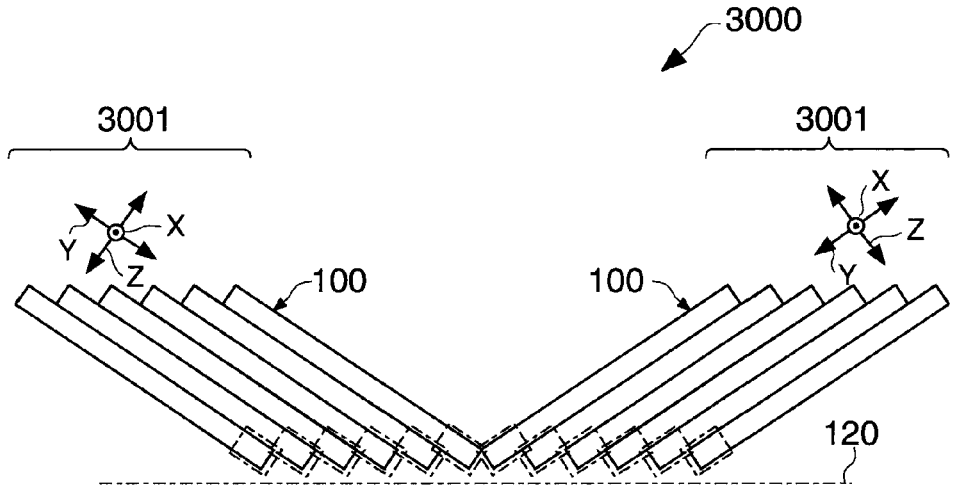
FIG. 4 is a schematic side view of a liquid jet head 3000 in accordance with an embodiment of the invention.
Figure 5:
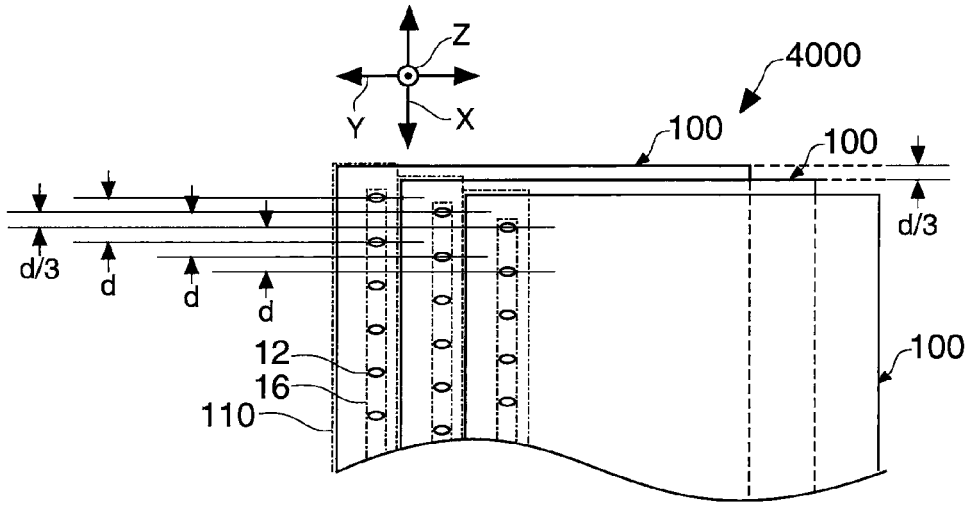
FIG. 5 is a schematic plan view of a liquid jet head 4000 in accordance with an embodiment of the invention.
Figure 6:
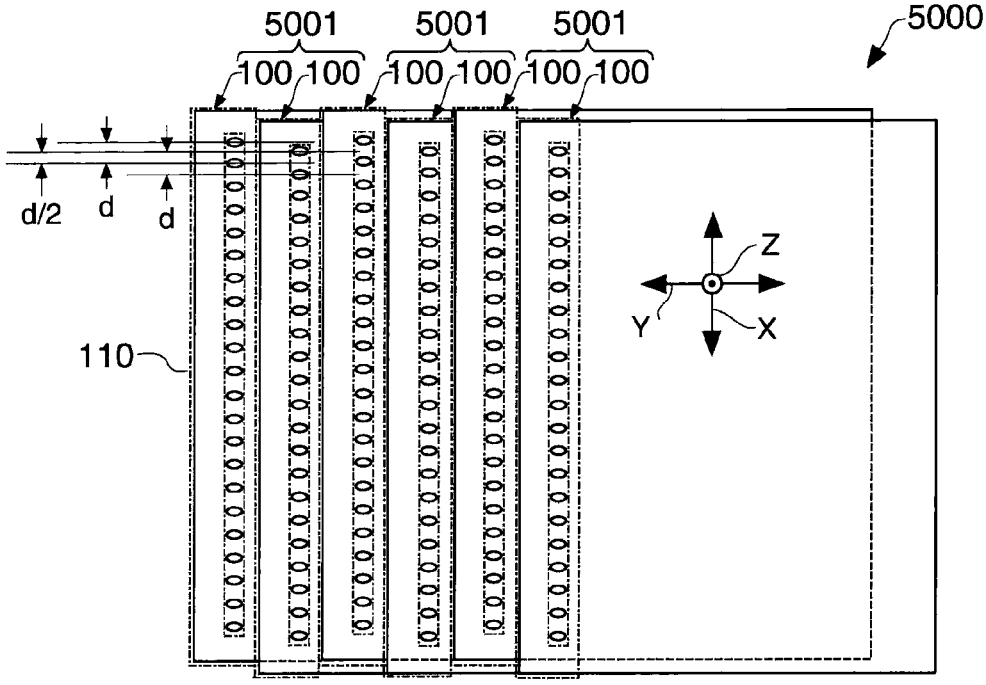
FIG. 6 is a schematic plan view of a liquid jet head 5000 in accordance with an embodiment of the invention.
Figure 7:
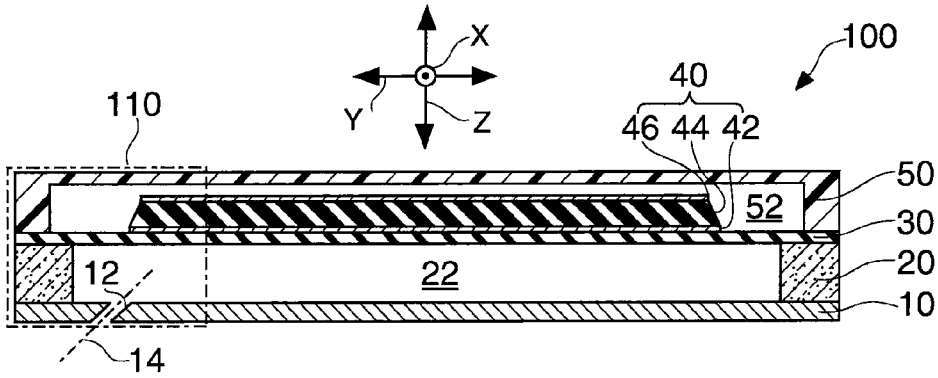
FIG. 7 is a schematic cross-sectional view of a unit head 100 in accordance with an embodiment of the invention.
Figure 8:
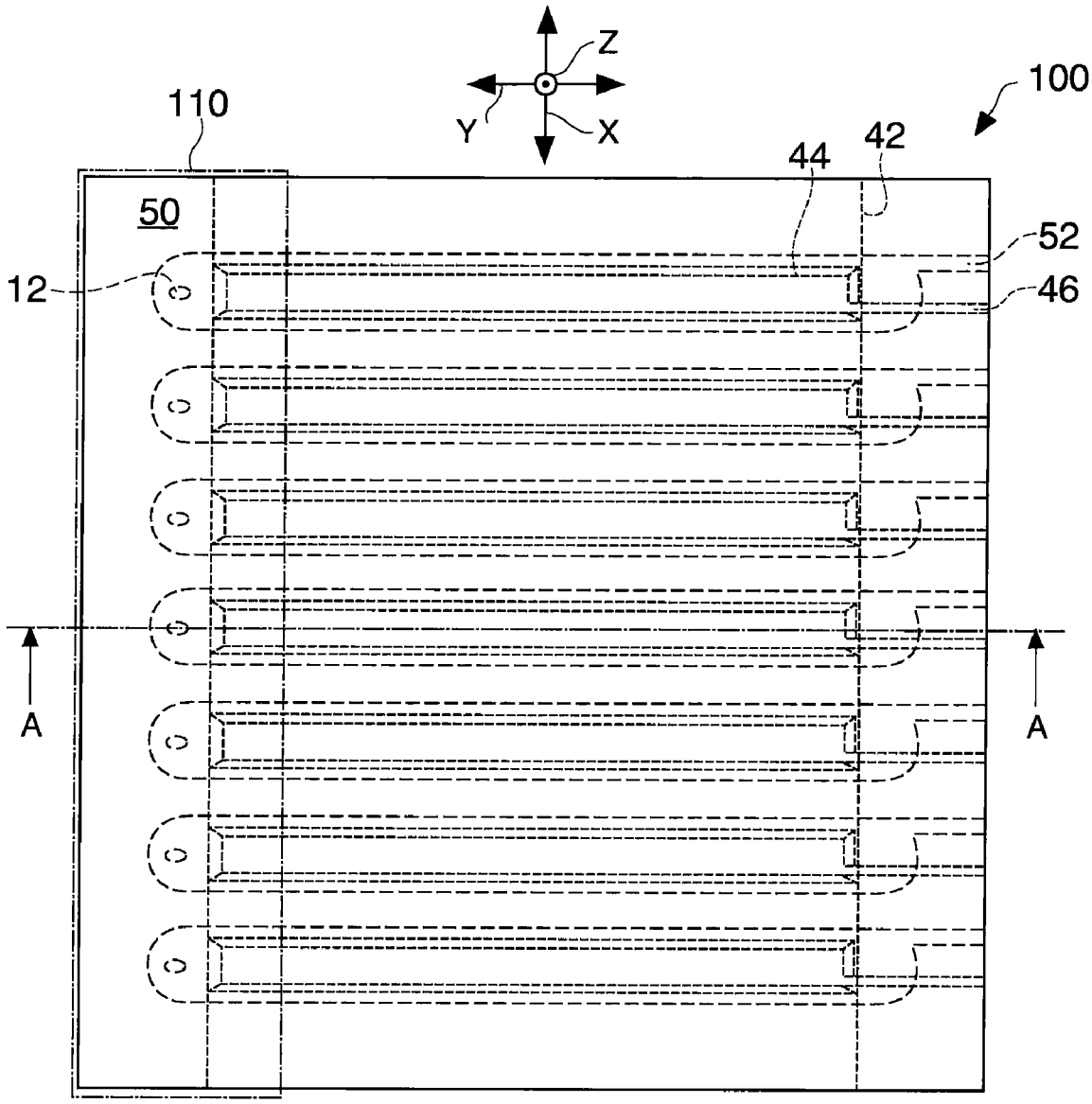
FIG. 8 is a schematic plan view of the unit head 100 in accordance with the embodiment.

FIG. 1 is a schematic perspective view of a liquid jet head 1000 in accordance with an embodiment of the invention. FIG. 2 is a schematic cross-sectional view of the liquid jet head 1000 of the present embodiment. FIG. 2 corresponds to a cross section S shown in FIG. 1. FIG. 3 is a schematic side view of a liquid jet head 2000 in accordance with an embodiment of the invention. FIG. 4 is a schematic side view of a liquid jet head 3000 in accordance with an embodiment of the invention. FIG. 5 is a schematic plan view in part of a liquid jet head 4000 in accordance with an embodiment of the invention. FIG. 6 is a schematic plan view of a liquid jet head 5000 in accordance with an embodiment of the invention. FIG. 7 is a schematic cross-sectional view of an example of a unit head 100 of a liquid jet head in accordance with an embodiment of the invention. FIG. 8 is a schematic plan view of the unit head 100 of the liquid jet head in accordance with the embodiment. A cross section taken along a line A-A in FIG. 8 corresponds to FIG. 7.

The liquid jet head in accordance with the present embodiment has a plurality of unit heads 100. Each of the plural unit heads 100 is equipped with a plurality of nozzle apertures 12 arranged along a first direction (X direction) in a nozzle forming region 110. The unit heads 100 are laminated in a manner that the nozzle forming regions 110 are shifted from one another in a second direction (Y direction) orthogonal to the first direction (X direction), wherein the unit heads 100 are laminated in a third direction (Z direction) orthogonal to the first direction (X direction) and the second direction (Y direction). Liquid is ejected from the nozzle apertures 12 in a fourth direction between the second direction (Y direction) and the third direction (Z direction). The liquid jet head 1000 shown in FIG. 1 and FIG. 2 has three unit heads 100 laminated on top of another. The liquid jet head 2000 shown in FIG. 3 has twelve unit heads 100 laminated together. The liquid jet head 3000 shown in FIG. 4 has two liquid jet heads 3001 (which are also liquid jet heads in accordance with an embodiment of the invention) each having six unit heads 100 laminated together, wherein the liquid jet heads 3001 are disposed opposing to each other in a manner that the nozzle forming regions 110 are arranged next to each other.

Each of the unit heads 100 may be formed from, for example, a thin film type ink jet head. In accordance with the present embodiment, the unit head 100 has a generally rectangular shape. The unit head 100 has a function to eject liquid from the nozzle apertures 12 in the fourth direction (hereafter also referred to as a YZ direction) between the Y direction and the Z direction. As shown in FIG. 2, the liquid ejected from the nozzle apertures 12 of the unit head 100 flies toward a medium P, which is shown on the lower left side in the figure, and is coated on the surface of the medium P. The unit head 100 is capable of coating liquid on the medium P. The unit head 100 may preferably have, for example, a plate shape with a small thickness in the Z direction, as shown in FIG. 1 and FIG. 2, so that the plural unit heads 100 can be laminated in the liquid jet head. If the thickness in the Z direction is too large, the nozzle rows 16 of adjacent ones of the unit heads are spaced a large distance, which is not desirable. In this respect, the unit head 100 may preferably have a structure having piezoelectric elements 40 each formed in a thin film shape in the Z direction, as shown in FIG. 2.

A plurality of nozzle apertures 12 are formed in the nozzle forming region 110. The nozzle apertures 12 are arranged in the nozzle forming region 110 along the X direction. The nozzle apertures 12 are capable of ejecting liquid in the YZ direction. The nozzle apertures 12 may be arranged linearly or zigzag along the X direction. The plural nozzle apertures 12 form a row along the X direction as a whole in the nozzle forming region 110, thereby forming a nozzle row 16. The interval of the nozzle apertures 12 in the nozzle row 16 may be optionally set, in consideration of the characteristic of each of the nozzle apertures 12 (driving frequency, the size of a droplet to be ejected, and the like), restrictions on its processing, and the like, in a manner that desired characteristics as a liquid jet head can be obtained.

The nozzle forming region 110 is a region that protrudes in the Y direction when adjacent ones of the unit heads 100 are laminated in a manner shifted in the Y direction, as shown in FIG. 1 through FIG. 4. The nozzle forming region 110 may be formed in any desired size in the unit head 100, but may preferably be formed in a thin strip along an end section of the unit head 100 in the Y direction. This allows the nozzle rows 16 of adjacent ones of the unit heads 100 to be disposed in a manner not to be separated too far from each other in the Y direction. In the illustrated example, the nozzle row 16 (in other words, the plurality of nozzle apertures 12) is formed along one side in the Y direction of the rectangular unit head 100, and arranged along the X direction. Accordingly, liquid ejected from the nozzle apertures 12 can reach the medium P without being blocked by the other unit heads 100. The liquid ejected from the nozzle apertures 12 fly in the YZ direction, and is coated on the surface of the medium P disposed generally orthogonal to the YZ direction (see FIG. 2).

The medium P is disposed in parallel with a plane 120 that can be formed by connecting end edges in the Y direction of the unit heads 100. The medium P may be a sheet of paper, a silicon wafer, a semiconductor device or the like. When specified ones of the nozzle apertures 12 of the liquid jet head reach a target position on the medium P, liquid is ejected from the specified nozzle apertures 12, and the liquid is coated at the target position on the medium P. The liquid may be any one of precursors of various types of metals, precursors of various types of dielectrics and the like.

The relative position between the medium P and the liquid jet head when coating the liquid can be changed by moving at least one of the medium P and the liquid jet head. The direction in which the relative position between the medium P and the liquid jet head is changed may be in a direction orthogonal to the X direction or a composite direction of the direction orthogonal to the X direction and the X direction within the plane 120 that is formed by connecting the end edges in the Y direction of the unit heads 100. When the width of a region in the medium P to be coated with the liquid is smaller than the width of the liquid jet head in the X direction, the liquid can be coated at desired positions of the medium P by only changing the relative position between the medium P and the liquid jet head within the plane 120 in the direction orthogonal to the X direction. On the other hand, when the width of a region in the medium P to be coated with the liquid is larger than the width of the liquid jet head in the X direction, the liquid is first coated while changing the relative position of the two in the direction orthogonal to the X direction, and then, the relative position of the two is changed in the X direction, and the liquid is again coated while changing the relative position in the direction orthogonal to the X direction, which may be repeated depending on the requirement, whereby the liquid can be coated at desired positions of the entire medium P. It is noted that the mode of changing the relative position between the medium P and the liquid jet head in this manner may also be referred to as raster scan or sequential scan.

In the liquid jet head in accordance with the present embodiment, the plurality of unit heads 100 are shifted from one another in the Y direction and laminated on top of another. Therefore, compared to a print head in related art in which a plurality of unit heads are disposed side by side in the Y direction in a plane, the interval of the nozzle rows 16 in the Y direction in accordance with the present embodiment is smaller. Therefore, when the liquid is ejected from the unit heads at target positions on the medium P while changing the relative position between the medium P and the liquid jet head in the direction orthogonal to the X direction along the plane 120 that is formed by connecting the ends in the Y direction of the unit heads, the positional accuracy in ejecting the liquid is high. In other words, when, after the liquid is ejected from a specified one of the nozzle rows 16 and coated at the target position on the medium P, the relative position of the medium P and the liquid jet head is changed in the direction orthogonal to the X direction such that another one of the nozzle rows 16 reaches the same target position, it becomes difficult for the position to be reached by the other nozzle row 16 to be deviated from the target position due to insufficient mechanical accuracy. Accordingly, the mechanical accuracy and assembly accuracy required for at least one of the moving mechanisms for the liquid jet head and the medium P can be alleviated.

The unit heads 100 of the liquid jet head in accordance with the present embodiment may be provided in any plural number without any particular limitation. For example, the liquid jet head 2000 in accordance with the present embodiment shown in FIG. 3 has twelve head units 100. The liquid jet head 2000 has nozzle rows 16 provided at small intervals and therefore can obtain the same effects described above. Further, the liquid jet head 3000 in accordance with the present embodiment is equipped with two liquid jet heads 3001, each having six head units 100 laminated together, which are disposed opposite to each other in a manner that the nozzle forming regions 110 are placed next to each other. The liquid jet head 3000 also has nozzle rows 16 provided at small intervals and therefore can obtain the effects described above.

Each of the unit heads 100 can eject the same liquid. By so doing, the liquid jet head in accordance with the present embodiment can densely coat the liquid in a plane on the medium P, whereby high-resolution or highly dense coating results can be obtained. Also, the unit heads 100 can be arranged to eject mutually different liquids. For example, when the liquid jet head 1000 is used as an ink jet head, one of the unit heads 100 can be used to eject liquid in darker color, and the other of the unit heads 100 can be used to eject liquid in lighter color. By so doing, the coating result can be obtained with good power of color expression. Also, for example, when the liquid jet head in accordance with the present embodiment is used as an ink jet head, the liquid jet head may be composed of four unit heads 100, which may be assigned to eject inks in cyan (C), magenta (M), yellow (Y) and black (B), and the four unit heads 100 are laminated together, whereby the liquid jet head can be obtained with the nozzle rows 16 for different colors closely arranged to one another.

1.2. Modified Example 1

The direction of liquid ejection by the nozzle apertures 12 can be modified in the following manner. The nozzle apertures 12 each have a cylindrical shape and a virtual center line 14 (see FIG. 2). The center line of each of the nozzle apertures 12 is oriented in the YZ direction. The YZ direction is inclined with respect to the Z direction. The center line 14 can be inclined with respect to the nozzle forming region 110 toward the exterior of the unit head 100. As a result, the distance from the nozzle aperture 12 to the medium P can be reduced to a smaller distance, whereby the accuracy of liquid coating position can be increased. Also, in accordance with the present embodiment, the medium P is provided in parallel with a plane formed by connecting ends in the Y direction of the unit heads 100. For this reason, the nozzle apertures 12 of the unit heads 100 can be spaced from a coating surface of the medium P at a generally constant distance. Furthermore, by setting the center lines 14 of the nozzle apertures 12 to be perpendicular to the plane (i.e., the surface of the medium P) formed by connecting the ends in the Y direction of the unit heads 100, the flying distance of the liquid can be minimized. As a result, bending of the trajectory of the liquid in flight due to a flow of the air atmosphere or the like can be controlled, such that the accuracy of liquid coating position can be increased.

1.3. Modified Example 2

The unit heads 100 may be laminated and shifted not only in the Y direction but also shifted in the X direction such that the nozzle apertures 12 are mutually shifted in the X direction (see FIG. 5). When the unit heads 100 are mutually shifted in the X direction, like the liquid jet head 4000 shown in FIG. 5, the nozzle apertures 12 of specified one of the head units 100 may be placed between the nozzle apertures 12 of another specified one of the head units 100 in a manner to supplement a gap between them, as viewed in the Y direction. As a result of such an arrangement of the unit heads 100, when the liquid is coated on the medium P by moving the relative position of the medium P and the liquid jet head 4000 in the direction orthogonal to the X direction along the plane 120 that is formed by connecting the ends in the Y direction of the unit heads 100, the liquid can be coated on the medium P at intervals smaller than the interval d of the nozzle apertures 12 of each of the unit heads 100 in the X direction. The liquid jet head 4000 shown as an example in FIG. 5 is composed of three unit heads 100, which are disposed in a manner mutually shifted in the X direction by ⅓ of the interval d of the nozzle apertures 12. As a result, the liquid can be coated on the medium P at ⅓ of the interval of the nozzle apertures 12 of a specified one of the unit heads 100. In other words, the liquid jet head 4000 can coat the liquid on the medium P with a resolution (coating density) three times the resolution of the unit head 100 (the density of nozzle apertures 12 in the X direction). The above may be generalized as follows. When a liquid jet head has m unit heads 100, and the unit heads 100 are disposed in a manner mutually shifted in the X direction by n/m (n is a natural number less than m) of the interval d of the nozzle apertures 12 of each of the unit heads 100, the liquid jet head can have a resolution that is m times the resolution (coating density) of the unit head 100. When the liquid jet head has three or more unit heads 100, the unit heads 100 may be shifted in the X direction in the same order as the order in which the unit heads 100 are laminated in the Z direction, or the unit heads 100 may be shifted in the X direction irrespective to the order in which the unit heads 100 are laminated in the Z direction, in either of the cases of which substantially the same effects can be obtained.

Moreover, like the liquid jet head 5000 shown in FIG. 6, a specified one of the unit heads 100 may be laminated at the same position as another one of the unit heads 100 in the X direction. In the example shown in FIG. 6, the liquid jet head 5000 has three liquid jet heads 5001 laminated together, wherein each of the liquid jet heads 5001 includes two head units 100 that are laminated in a manner mutually shifted by ½ of the interval d of the nozzle apertures 12 in the X direction. Stated otherwise, the liquid jet head 5000 has six unit heads 100 laminated in a manner mutually shifted by ½ of the interval of the nozzle apertures 12. According to the liquid jet head 5000, the composing liquid jet heads 5001 may be used to eject mutually different kinds of liquid, such that the liquid of the different kinds can be coated on the medium P with high resolution, and the plural kinds of liquid can be coated in one scanning with high positional accuracy.

According to the liquid jet head in accordance with the present modified example, the nozzle apertures 12 of one of the unit heads 100 are placed between the nozzle apertures 12 of another of the unit heads 100, respectively, as viewed in the Y direction. Therefore, when the liquid jet head is scanned in the direction orthogonal to the X direction with respect to the medium P within the plane 120 that is formed by connecting the ends in the Y direction of the unit heads 100, the liquid can be coated on the medium P at an interval narrower than the interval d of the nozzle apertures 12 in the X direction. Accordingly, when the multiple unit heads 100 are used to eject the same liquid, a higher resolution can be obtained, compared to that of a single unit head 100. When the multiple unit heads 100 are used to eject different liquids, for example, the power of color expression can be improved, compared to that of a single unit head 100.

1.4. Unit Head

Next, unit heads 100 suitable for the liquid jet head in accordance with preferred embodiments of the invention are described. As shown in FIG. 7 and FIG. 8, the unit head 100 may have a nozzle plate 10, a pressure chamber substrate 20, an elastic plate 30, piezoelectric elements 40 and a sealing plate 50.

The nozzle plate 10 has a function to serve as a lower wall of pressure chambers 22. The nozzle plate 10 has a plurality of nozzle apertures 12 for ejecting liquid at locations corresponding to the pressure chambers 22. The nozzle apertures 12 are arranged in the X direction. The nozzle apertures 12 are formed in a manner that their center lines 14 are inclined with respect to the normal direction of the nozzle plate 10. As described above, the direction of inclination of the center lines 14 can be set in a direction in which liquid can be ejected from the center of the nozzle plate 10 outwardly. Also, when plural unit heads 100 are laminated in a manner shifted from one another, the nozzle apertures 12 can be provided in a manner that their center lines 14 are oriented in a direction orthogonal to a plane connecting the ends in the Y direction of the unit heads 100. The plural nozzle apertures 12 in the X direction may be arranged linearly or zigzag. The nozzle apertures 12 may preferably be formed at positions along one end of the nozzle plate 10 in the Y direction, as long as they can be continuous with the pressure chambers 22. By this structure, when the unit heads are used for the liquid jet head in accordance with the present embodiment, the interval between adjacent ones of the nozzle rows 16 of the unit heads 100 can be made smaller, and the positional accuracy in coating the liquid on the medium P by the liquid jet head can be increased. The nozzle plate 10 may be formed from any material without any particular limitation, and for example, silicon or stainless steel may preferably be used.

The pressure chamber substrate 20 is provided above the nozzle plate 10. Pressure chambers 22 are provided in the pressure chamber substrate 20. The pressure chambers 22 are provided in plurality in communication with the plurality of nozzle apertures 12, respectively. As the material for the pressure chamber substrate 20, conductive material, semiconductor material or dielectric material may be used. Above all, for the pressure chamber substrate 20, a material that is suitable for the high temperature (typically at 600° C. to 800° C.) step for forming piezoelectric elements above and the step for forming the pressure chambers 22 may preferably be used, and a silicon (110) substrate that can obtain high processing accuracy through anisotropic etching, and can withstand high temperature processing is particularly favorable.

The elastic plate 30 is provided above the pressure chamber substrate 20. The elastic plate 30 is in contact with the piezoelectric elements 40. The elastic plate 30 has elasticity for causing flexural vibration. Also, the elastic plate 30 has a function to change the volume of the pressure chamber 22 through deforming by the operation of the piezoelectric element 40. In other words, when the volume of the pressure chamber 22 that is filled with liquid becomes smaller, the pressure within the pressure chamber 22 becomes greater, and the liquid is ejected through the nozzle aperture 12 of the nozzle plate 10 provided below. As the material for the elastic plate 30, any material with an appropriate mechanical strength may preferably be used without any particular limitation. When the elastic plate 30 is formed from a material without sufficient strength, the rigidity of the elastic plate is lost and its oscillation period becomes longer, such that the driving frequency of the head cannot be raised higher. On the other hand, when a material that is too hard is used, the amount of flexing of the elastic plate is reduced, such that the size of a liquid droplet that can be ejected becomes smaller. The elastic plate may be formed in an optimum thickness that can satisfy the specific characteristic of volume change of the pressure chamber 22, in consideration of the characteristics such as Young's modulus of the material used, the rigidity of the vibration plate and the like. As the material for the elastic plate 30, for example, zirconium oxide, silicon nitride, silicon oxide or aluminum oxide may preferably be used.

A plurality of piezoelectric elements 40 are provided above the elastic plate 30 and above the pressure chambers 22 at locations corresponding to the pressure chambers 22. Each of the piezoelectric elements 40 is formed from a lower electrode 42, a piezoelectric layer 44 and an upper electrode 46 laminated on top of another.

The lower electrode 42 is formed on and in contact with the elastic plate 30. The lower electrode 42 may be in any thickness as long as it is in a range in which deformation of the piezoelectric layer 44 can be transmitted to at least the elastic plate 30. The thickness of the lower electrode 42 may be, for example, about 20 nm to 400 nm. The lower electrode 42 pairs with the upper electrode 46, thereby sandwiching the piezoelectric element 44, and functions as one of the electrodes of the piezoelectric element 40. The lower electrode 42 may be made of any material without any particular limitation as long as the material has conductivity that satisfies the function described above. As the material for the lower electrode 42, a variety of metals, such as, nickel, iridium, platinum and the like, conductive oxides of the foregoing metals (for example, iridium oxide), complex oxide of strontium and ruthenium, and the like may be used. Also, the lower electrode 42 may be in a single layer of any one of the materials exemplified above, or a structure in which layers of plural ones of the materials are laminated.

The piezoelectric layer 44 is formed on and in contact with the lower electrode 42. The piezoelectric layer 44 is formed in a thickness that can secure its mechanical reliability, for example, 300 nm to 1500 nm. The piezoelectric layer 44 deforms in extension and contraction upon application of an electric field by the lower electrode 42 and the upper electrode 46, thereby functioning to vibrate the elastic plate 30. The piezoelectric layer 44 may be formed from a material having piezoelectricity. As the material for the piezoelectric layer 44, oxides containing lead, zirconium and titanium as constituent elements may preferably be used. Lead zirconate titanate is favorable as the material for the piezoelectric layer 44 because of its excellent piezoelectricity.

The upper electrode 46 is formed on and in contact with the piezoelectric layer 44. The upper electrode 46 may be formed in any thickness without any particular limitation as long as it is in the range that does not adversely affect the operation of the piezoelectric element 40. The upper electrode 46 may have a thickness of about 10 nm-400 nm, for example. The upper electrode 46 may be made of any material without any particular limitation as long as the material has conductivity that satisfies the function described above. The material for the upper electrode 46 may be the same as that of the lower electrode 42.

The sealing plate 50 is provided above the piezoelectric element 40, as shown in FIG. 6, in a manner to cover the piezoelectric element 40 through a space 52 between them. The sealing plate 50 does not contact the piezoelectric element 40. The sealing plate 50 is illustrated, in the example shown in FIGS. 6 to 8, in a manner to cover a plurality of piezoelectric elements 40, but may be provided in a manner to cover individually each of the piezoelectric elements 40. Also, the sealing plate 50 may be provided with columns (pillars) for spacing the sealing plate 50 from the piezoelectric elements 40 (not shown). The sealing plate 50 has a function to prevent the piezoelectric elements 40 from contacting other members when the unit heads 100 are laminated. The sealing plate 50 may have a function to air-tightly seal a space 52 inside the sealing plate 50. The space 52 may be in a reduced pressure state. The sealing plate 50 may be formed in any thickness without any particular limitation as long as it has the mechanical strength described above. The sealing plate 50 may be formed from, for example, polymer material such as polyimide, silicon nitride, silicon oxide, or aluminum oxide.

The unit head 100 described above has the piezoelectric elements 40 in a thin-film form. Therefore the unit head 100 can be formed into a thin structure as a whole. Accordingly, the unit heads 100, even when laminated, do not become too thick. Therefore, in the liquid jet head in accordance with the present embodiment, the nozzle apertures 12 between adjacent ones of the unit heads 100 can be arranged at a short distance. Therefore, the unit heads 100 can be favorably used for the liquid jet head in accordance with the present embodiment.

1.5. Method for Manufacturing Liquid Jet Head

The liquid jet head in accordance with the present embodiment may be manufactured through laminating the unit heads 100 described above in a desired number in the Z direction. In the process for manufacturing the head units 100, the nozzle apertures 12 may be formed in the nozzle plate 10 by a mechanical punching method, or a method combining an ion etching or a dry etching with a photolithography method. The liquid jet head in accordance with the present embodiment may be manufactured through, for example, laminating a unit head 100 on another unit head 100 in a lower layer, which may be repeated a desired number of times depending on the requirement. According to a lamination method, the unit head 100 in an upper layer is laminated on the unit head 100 in a lower layer in a manner shifted in the Y direction such that the nozzle apertures 12 formed in the unit head 100 in the upper layer are not covered by the unit head 100 in the lower layer, and also shifted in the X direction by a distance smaller than the interval of the nozzle apertures 12 depending on the requirement. The plurality of unit heads 100 may be mutually affixed to one another by adhesive or the like. Also, a known position aligning device may be used for arranged the unit heads 100 at predetermined positions.

2. Second Embodiment

2.1. Line Type Liquid Jet Head

Figure 9:
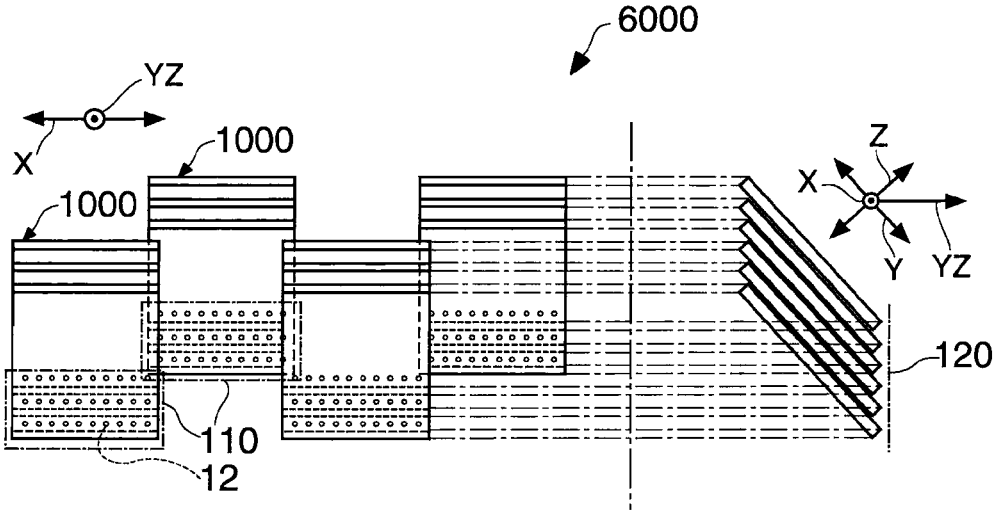
FIG. 9 schematically shows a plan view and a side view of a line type liquid jet head 6000 in accordance with an embodiment of the invention.
Figure 10:
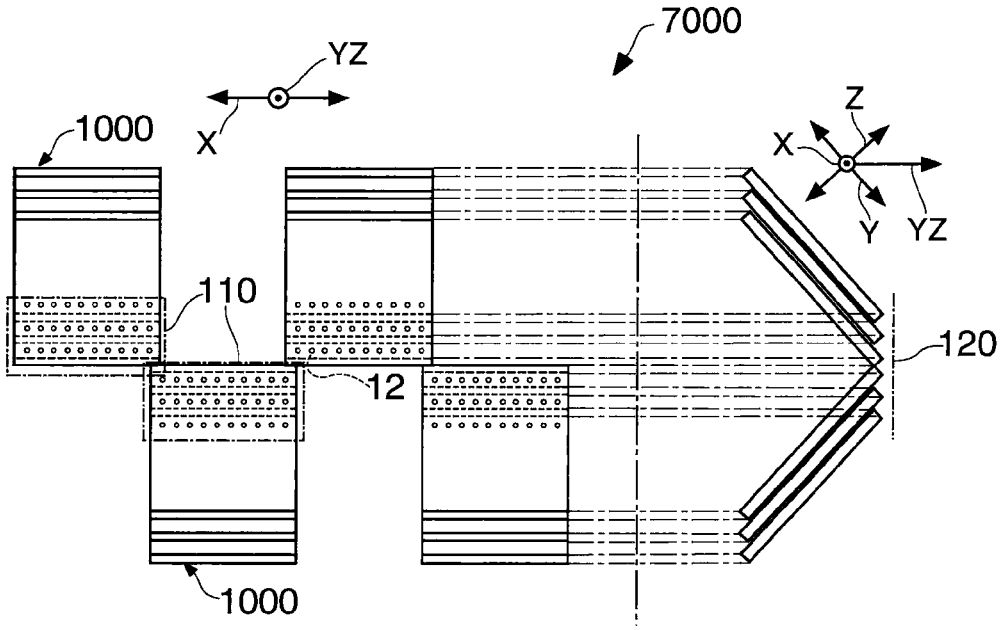
FIG. 10 schematically shows a plan view and a side view of a line type liquid jet head 7000 in accordance with an embodiment of the invention.

FIG. 9 schematically shows a plan view and a side view of a line type liquid jet head 6000 in accordance with an embodiment of the invention. FIG. 10 schematically shows a plan view and a side view of a line type liquid jet head 7000 in accordance with an embodiment of the invention. Arrows indicating directions are shown near each of the figures.

The line type liquid jet head in accordance with the present embodiment has a plurality of liquid jet heads of the first embodiment. In the line type liquid jet head 6000 and the line type line type liquid jet head 7000 shown in FIG. 8 and FIG. 9, a plurality of liquid jet heads are arranged in a staggered fashion along the X direction (first direction). Nozzle forming regions 110 of each of the liquid jet heads are arranged next to each other. In the line type liquid jet head 6000 and the line type liquid jet head 7000, the nozzle forming regions 110 in which the nozzle apertures 12 are arranged are disposed next to each other in the Y direction (second direction). Further, the nozzle rows 16 of the liquid jet heads are arranged to be continuous in the X direction (first direction).

In the example of the line type liquid jet head 6000 shown in FIG. 9, four liquid jet heads 1000 each having three unit heads 100 laminated together are arranged in a manner that the nozzle forming regions 110 are arranged next to each other in the same direction, and arranged in a staggered fashion along the X direction. In the example of the line type liquid jet head 7000 shown in FIG. 10, four liquid jet heads 1000 each having three unit heads 100 laminated together are arranged in a manner that the nozzle forming regions 110 are arranged next to each other in a manner opposing to one another, and arranged in a staggered fashion along the X direction. As a result, in both of the examples of the line type liquid jet head 6000 and the line type liquid jet head 7000, the nozzle apertures 12 are continuous in the X direction. According to the line type liquid jet head 6000 and the line type liquid jet head 7000, when their relative position with respect to a medium P is changed in a direction orthogonal to the X direction along a plane 120 that is formed by connecting ends (ends of the nozzle forming regions 110) in the Y direction of the unit heads 100, an area four times larger than the area that may be coated by a single liquid jet head can be coated on the medium. By this, when the relative position between the line type liquid jet head and the medium P is changed to coat a predetermined area, the operation required to move the line type liquid jet head or the medium P can be reduced. Also, for example, when liquid is coated by raster scanning, the number of scanning operations can be reduced.

The number of liquid jet heads of the first embodiment to be provided on the line type liquid jet head in accordance with the present embodiment may be arbitrarily selected. Therefore, for example, the number of liquid jet heads may be increased such that the length of the line type liquid jet head in the X direction becomes greater than the width of the medium P in the X direction, whereby desired liquid can be coated at target positions on the medium P by simply scanning either the medium P or the line type liquid jet head to move the relative position with respect to the medium P in the direction orthogonal to the X direction along the plane 120 that is formed by connecting the edges in the Y direction of the unit heads 100. For this reason, according to the line type liquid jet head described above, the raster scanning operation becomes unnecessary, such that the mechanism and control devices for raster scanning can be omitted.

Figure 11:
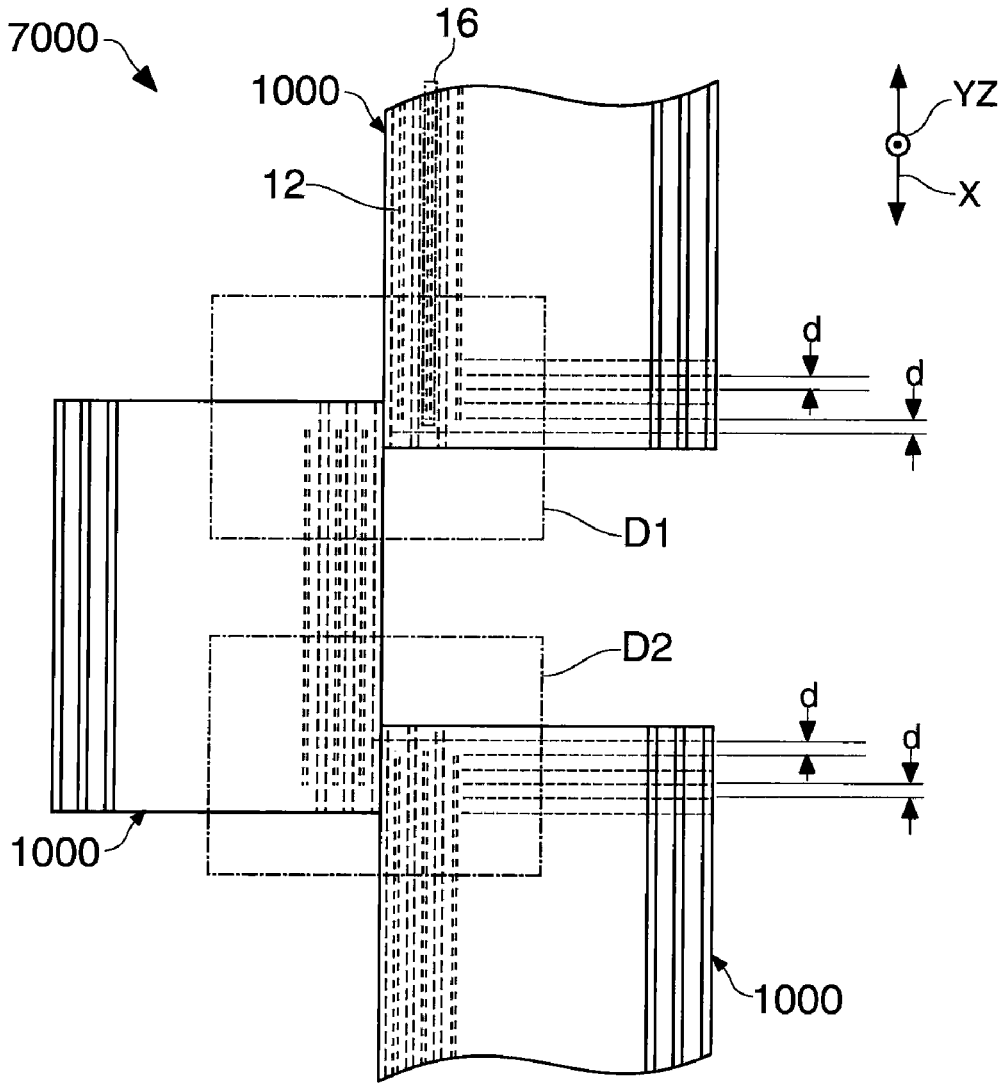
FIG. 11 schematically shows a plan view of the line type liquid jet head 7000 in accordance with the embodiment.

In the line type liquid jet head 6000 and the line type liquid jet head 7000, the liquid jet heads 1000 are arranged in a staggered fashion along the X direction, and also may be arranged with overlapping regions D1 and overlapping regions D2 as shown in FIG. 11. Furthermore, as shown in FIG. 11, the degree of overlapping of the overlapping region D1 and the overlapping region D2 in the Y direction can be adjusted such that the pitch of the nozzle apertures 12 (the interval d, or 1/m of the interval d) becomes constant in the X direction. In other words, when the line type liquid jet head is viewed in the direction orthogonal to the X direction along the plane 120 formed by connecting the ends in the Y direction of the unit heads 100, the amount of overlapping between the liquid jet heads 1000 in the X direction can be adjusted such that the pitch (interval d) of the nozzle apertures 12 of each of the liquid jet heads 1000 can be maintained in the boundary region between a specified one of the liquid jet heads 1000 and the adjacent one of the liquid jet heads 1000. In the overlapping region D1 shown in FIG. 11, adjacent ones of the liquid jet heads 1000 are disposed in a manner that the interval of the nozzle apertures 12 in their ends has the pitch of the interval d of the nozzle apertures, as viewed in the direction orthogonal to the X direction along the plane 120 formed by connecting the ends in the Y direction of the unit heads 100. Also, in the overlapping region D2 shown in FIG. 11, adjacent ones of the liquid jet heads 1000 are disposed in a manner that the nozzle apertures 12 at connections overlap one another while maintaining a constant pitch in the X direction.

By so doing, when the line type liquid jet head or the medium P is scanned in the direction orthogonal to the X direction along the plane 120 formed by connecting the ends in the Y direction of the unit heads 100, liquid can be coated on the medium P without changing the pitch (resolution) at the boundary (at the connection) between adjacent ones of the liquid jet heads 1000. It is noted that, when the nozzle apertures 12 of two of the liquid jet heads 1000 overlap one another in the X direction, as in the overlapping region D2 shown in FIG. 11, for example, the liquid ejection may be controlled in a manner that one of the liquid jet heads 1000 does not eject liquid, whereby the amount of liquid to be coated can be adjusted.

The line type liquid jet head in accordance with the present embodiment has a plurality of the liquid jet heads of the first embodiment. Therefore, the interval between the nozzle rows 16 of the unit heads in the Y direction is smaller, for example, compared to the case where the unit heads 100 are arranged side by side in the Y direction in a plane. For this reason, like the liquid jet head 1000, when liquid is ejected from the unit heads 100 and coated at specified positions on the medium P while changing the relative position between the medium P and the liquid jet heads in the direction orthogonal to the X direction along the plane 120 formed by connecting the ends in the Y direction of the unit heads 100, the accuracy in the coating positions is high. Accordingly, by the line type liquid jet head in accordance with the present embodiment, like the liquid jet head in accordance with the first embodiment, the degree of mechanical accuracy and assembly accuracy required for the shifting mechanism of at least one of the liquid jet head and the medium P can be alleviated. Also, in each of the liquid jet heads in the line type liquid jet head in accordance with the present embodiment, the unit heads 100 can be disposed in a manner shifted from one another in the X direction, as described in conjunction with the first embodiment. As a result, the resolution (coating density) in coating the liquid on the medium can be increased higher than the case of a single unit head 100.

3. Third Embodiment

3.1. Printer

A printer in accordance with the present embodiment has the liquid jet head in accordance with the first embodiment. The embodiment is described here using an example in which the printer 8000 in accordance with the present embodiment is an ink jet printer.

Figure 12:
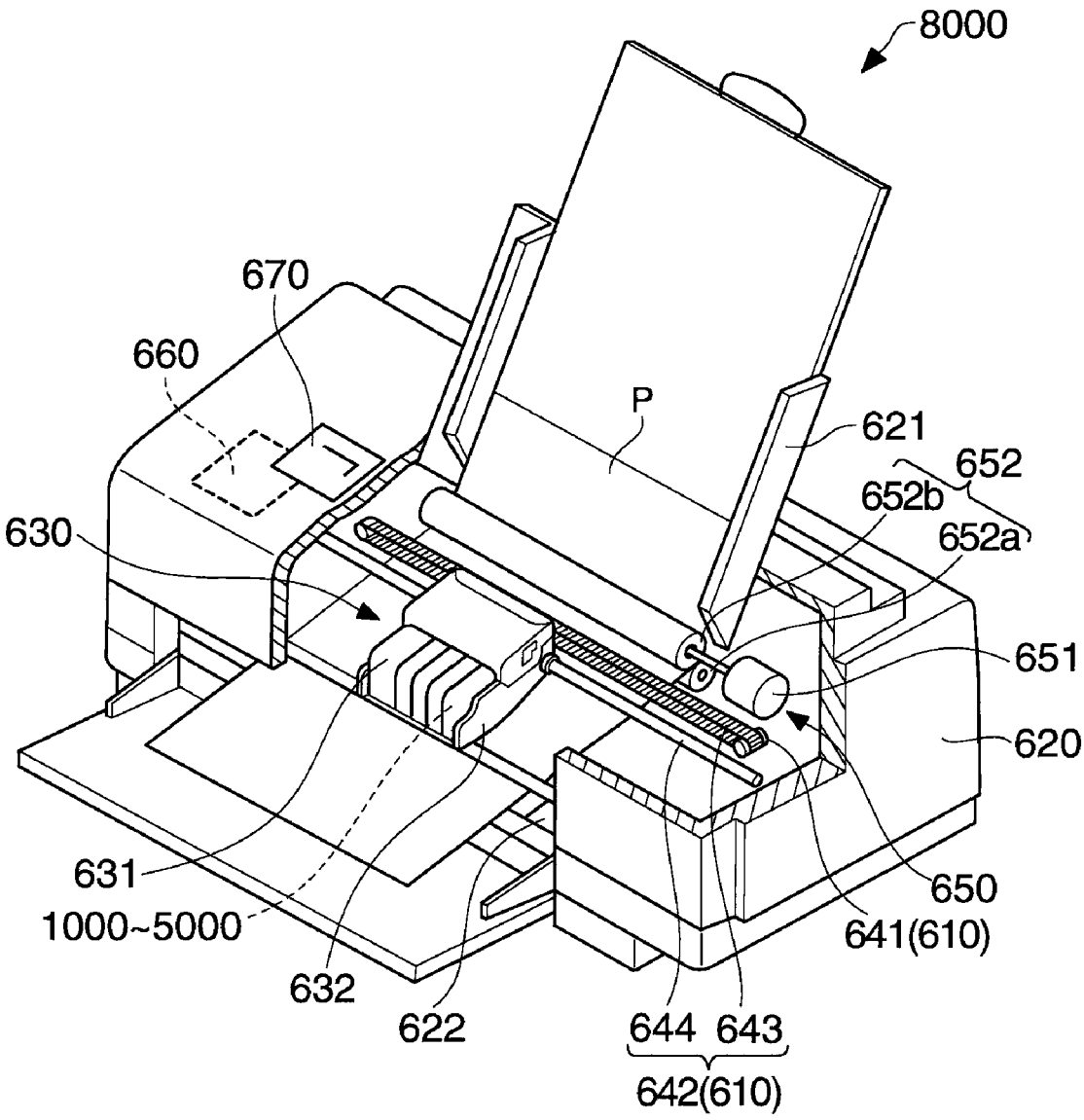
FIG. 12 is a schematic perspective view of a printer 8000 in accordance with an embodiment of the invention.

FIG. 12 is a schematic perspective view of the printer 8000 in accordance with the present embodiment. The printer 8000 includes a head unit 630, a driving section 610, and a controller section 660. Also, the printer 8000 may include an apparatus main body 620, a paper feed section 650, a tray 621 for holding media P (recording paper), a discharge port 622 for discharging the media P, and an operation panel 670 disposed on an upper surface of the apparatus main body 620.

The head unit 630 includes an ink jet recording head (hereafter simply referred to as the "head") that is composed of liquid jet heads in accordance with the first embodiment (for example, any of the liquid jet heads 1000 to 5000). The head unit 630 is further equipped with ink cartridges 631 that supply inks to the head, and a transfer section (carriage) 632 on which the head and the ink cartridges 631 are mounted.

The driving section 610 is capable of reciprocally moving the head unit 630. The driving section 610 includes a carriage motor 641 that is a driving source for the head unit 630, and a reciprocating mechanism 642 that receives rotations of the carriage motor 641 to reciprocate the head unit 630. The liquid jet head or the compound liquid jet head (a reference numeral 1000-5000 in the figure) is mounted to the head unit 630 in a manner that the reciprocating direction of the head unit 630 coincides with a direction orthogonal to the X direction along the plane 120 formed by connecting the ends in the Y direction of the unit heads 100 in the head.

The reciprocating mechanism 642 includes a carriage guide shaft 644 with its both ends being supported by a frame (not shown), and a timing belt 643 that extends in parallel with the carriage guide shaft 644. The carriage 632 is supported by the carriage guide shaft 644, in a manner that the carriage 632 can be freely reciprocally moved. Further, the carriage 632 is affixed to a portion of the timing belt 643. By operations of the carriage motor 641, the timing belt 643 is moved, and the head unit 630 is reciprocally moved, guided by the carriage guide shaft 644. During these reciprocal movements, ink is jetted from the head and printed on the medium P.

The control section 660 can control the head unit 630, the driving section 610 and the paper feeding section 650.

The paper feeding section 650 can feed the media P from the tray 621 toward the head unit 630. The paper feeding section 650 includes a paper feeding motor 651 as its driving source and a paper feeding roller 652 that is rotated by operations of the paper feeding motor 651. The paper feeding roller 652 is equipped with a follower roller **652*a* and a driving roller 652*b* that are disposed up and down and opposite to each other with a feeding path of the medium P being interposed between them. The driving roller 652*b* is coupled to the paper feeding motor 651. When the paper feeding section 650 is driven by the control section 660, the medium P is fed in a manner to pass below the head unit 630**.

The head unit 630, the driving section 610, the control section 660 and the paper feeding section 650 are provided inside the apparatus main body 620.

It is noted that, in the example described above, the printer 8000 is an ink jet printer. However, the printer in accordance with the present embodiment is also applicable to an industrial liquid jet apparatus. As liquid (liquid material) to be jetted in this case, a variety of liquids each containing a functional material whose viscosity is adjusted by a solvent or a disperse medium may be used.

The printer 8000 in accordance with the present embodiment excels in accuracy in coating droplets on a print object as its recording head has the liquid jet heads described above. More specifically, at the time of printing, positional deviations of droplets are suppressed, such that high coating positional accuracy can be obtained on the printing object. In addition, when the unit heads 100 in the liquid jet head are disposed in a manner shifted from one another in the X direction as described above, the printer 8000 in accordance with the present embodiment can achieve a high printing resolution on a print medium when ink is printed on a medium such as a sheet of paper.

4. Fourth Embodiment

4.1. Line Type Printer

A line type printer in accordance with the present embodiment has the line type liquid jet head in accordance with the second embodiment. The embodiment is described here using an example in which the line type printer 9000 in accordance with the present embodiment is an ink jet printer.

Figure 13:
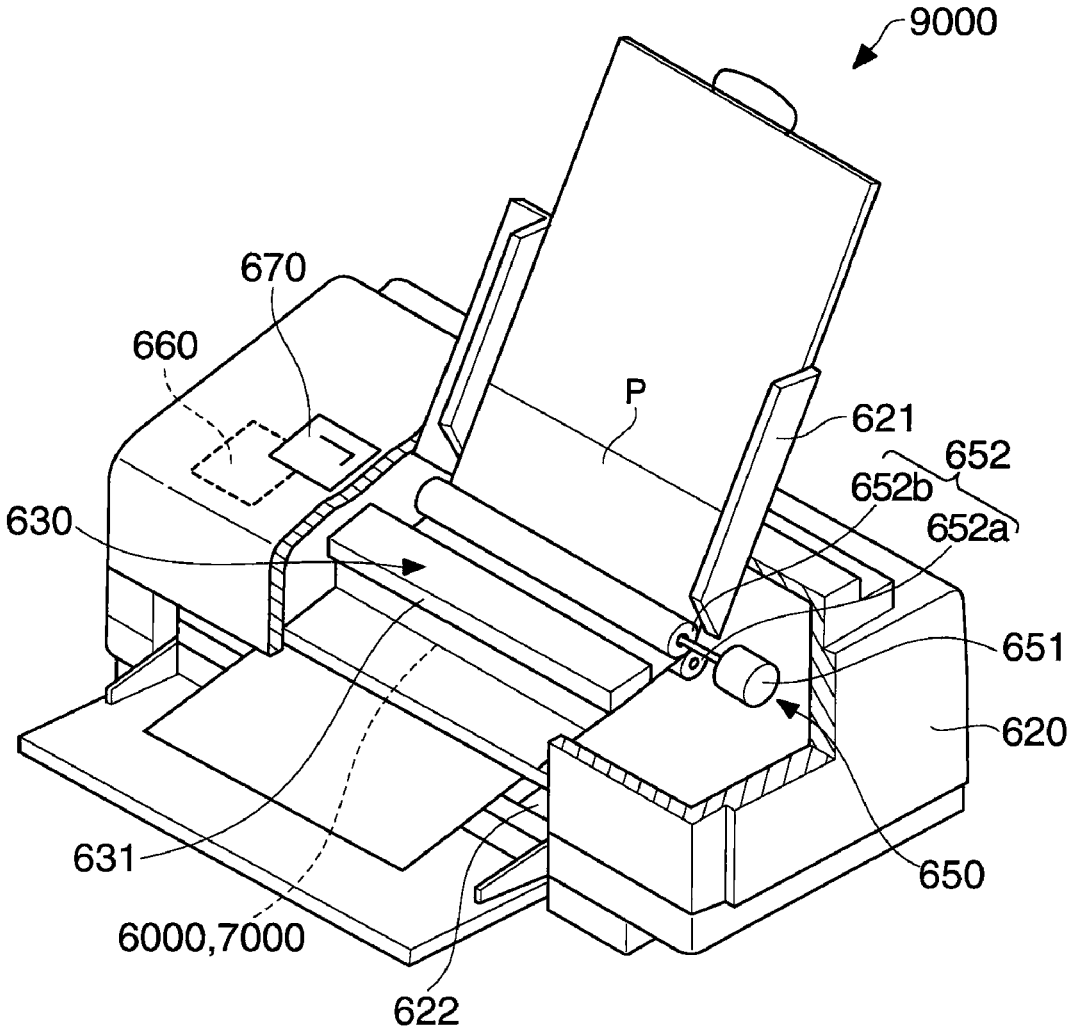
FIG. 13 is a schematic perspective view of a line type printer 9000 in accordance with an embodiment of the invention.

FIG. 13 is a schematic perspective view of the line type printer 9000 in accordance with the present embodiment. The line type printer 9000 includes a head unit 630 and a controller section 660. The line type printer 9000 does not have a driving section 610, which is provided in the printer 8000 in accordance with the third embodiment. The line type printer 9000 may include an apparatus main body 620, a paper feed section 650, a tray 621 for holding media P (recording paper), a discharge port 622 for discharging the media P, and an operation panel 670 disposed on an upper surface of the apparatus main body 620. Members other than the head unit 630 of the line type printer 9000 are generally the same as those of the printer 8000, and therefore detailed description of these members shall be omitted.

The head unit 630 includes an ink jet recording head (hereafter simply referred to as the "head") that is composed of line type liquid jet heads in accordance with the third embodiment. The line type liquid jet head in accordance with the present embodiment has a dimension in the X direction greater than the width of the medium P. The head unit 630 is further quipped with ink cartridges 631 that supply inks to the head.

The line type liquid jet head 9000 is mounted to the head unit 630 in a manner that the moving direction of the medium P coincides with a direction orthogonal to the X direction along the plane 120 formed by connecting the ends in the Y direction of the unit heads 100 in the head.

The control section 660 controls to operate the paper feeding section 650 and drive the head unit 630, whereby ink is coated at desired positions on the medium P while changing the relative position between the line type liquid jet head 7000 and the medium P, and thus printing on the medium P is conducted.

It is noted that the example is described above as to the case where the line type printer is an ink jet printer. However, the line type printer in accordance with the present embodiment is also applicable to an industrial liquid jet apparatus. As liquid (liquid material) to be jetted in this case, a variety of liquids each containing a functional material whose viscosity is adjusted by a solvent or a disperse medium may be used.

The line type printer in accordance with the present embodiment excels in accuracy in coating droplets on a print object as its recording head has the line type liquid jet heads described above. More specifically, at the time of printing, positional deviations of droplets are suppressed, such that high coating positional accuracy can be obtained on the printing object. In addition, when the unit heads 100 in the line type liquid jet head are disposed in a manner shifted from one another in the X direction, a high printing resolution on a print medium can be achieved when ink is printed on a medium such as a sheet of paper.

5. Fifth Embodiment

5.1. Film Forming Apparatus

A film forming apparatus in accordance with the present embodiment includes a liquid jet head in accordance with the first embodiment or a line type liquid jet head in accordance with the second embodiment. The present embodiment is described using an example in which the film forming apparatus in accordance with the present embodiment is a film forming apparatus 10000 for manufacturing display devices, which has a liquid jet head 1000 in accordance with the first embodiment. It is noted that the display device may be, for example, a liquid crystal display, a plasma display, an organic EL display, an electrophoretic display or the like, and the film forming apparatus 10000 in accordance with the present embodiment may be used for forming desired patterns on color filters, display substrates and the like included in those devices.

Figure 14:
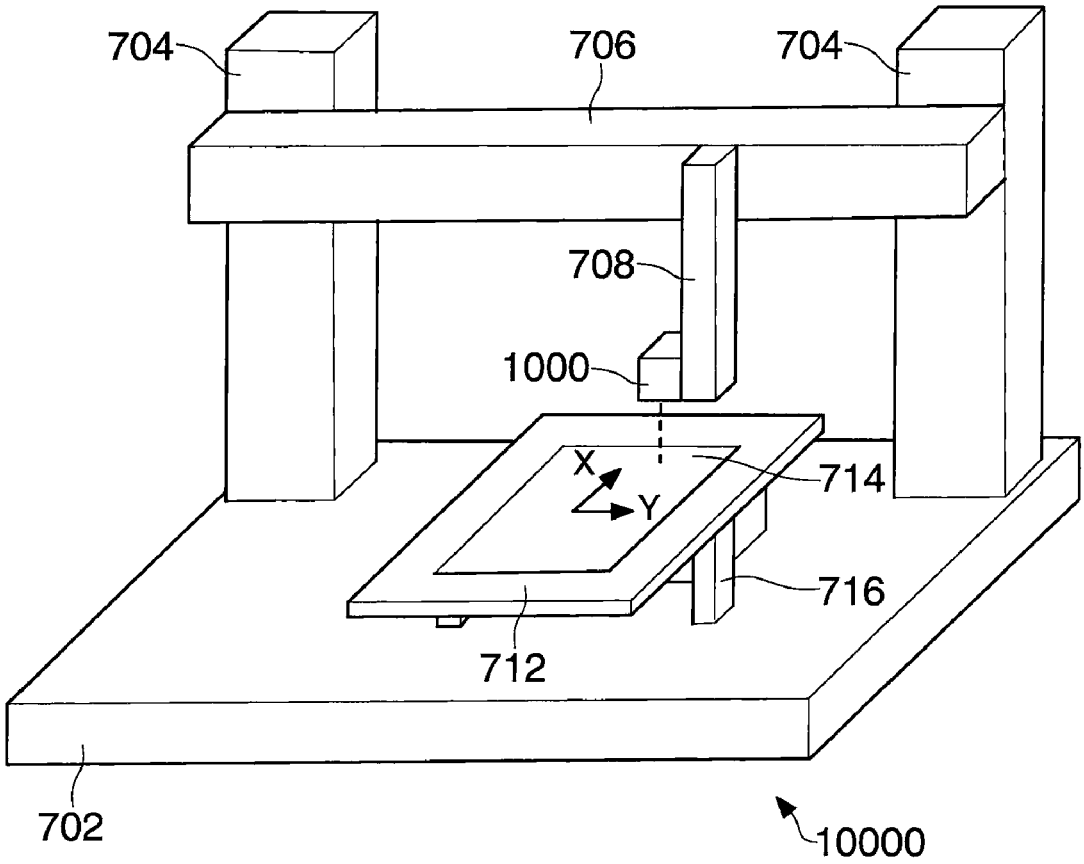
FIG. 14 is a schematic perspective view of a film forming apparatus 10000 in accordance with an embodiment of the invention.
Figure 15:
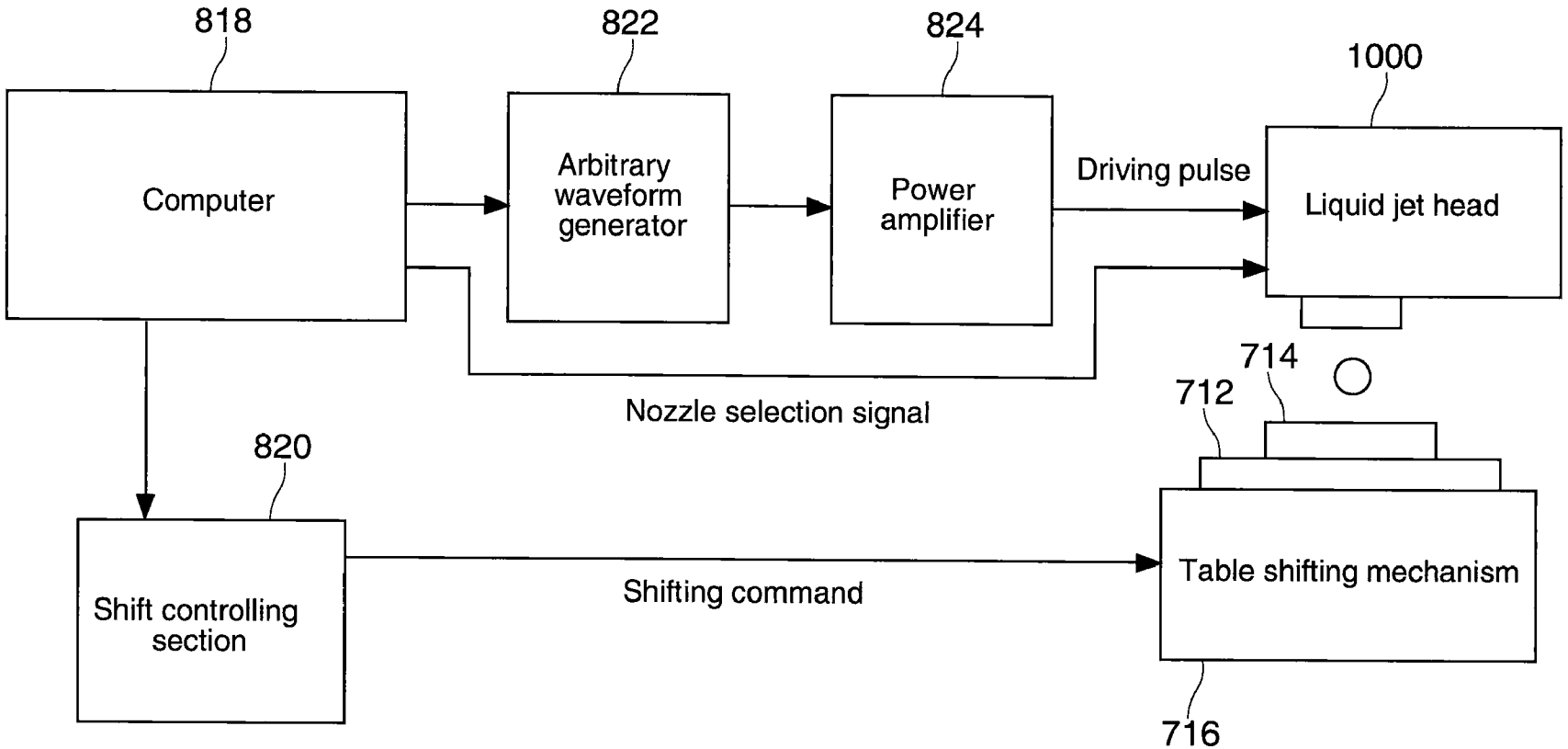
FIG. 15 is a schematic diagram of a control system for the film forming apparatus 10000 in accordance with an embodiment of the invention.

FIG. 14 is a schematic perspective view of a film forming apparatus 10000 in accordance with the present embodiment of the invention. FIG. 15 is a block diagram of a control system for the film forming apparatus 10000 shown in FIG. 14.

As shown in FIG. 14, the film forming apparatus 10000 in accordance with the present embodiment includes, at least, a rack 702, posts 704 that are supported by the rack 702, a horizontal beam 706 supported by the posts 704, a carrier 708 mounted on the horizontal beam 706, a liquid jet head 1000 mounted on the carrier 708, and a table 712 that is supported by the rack 702 and is capable of mounting a film forming object 717 on which films are formed.

In the present embodiment, the film forming object 714 may be, for example, a glass substrate used for a display device, and the following description exemplifies a mode in which droplets are adhered on a glass substrate by the film forming apparatus 10000 thereby forming patterns on the glass substrate. The glass substrate may be in any shape and size without any particular limitation, and may be in a rectangle having a side dimension of 1-100 cm.

The film forming apparatus 10000 is equipped with a mechanism that moves the relative position between the carrier 708 equipped with the liquid jet head 1000 and the table 712 in x direction and y direction. As the mechanism, a table shifting mechanism 716 for moving the table 712 and/or a mechanism (not shown) for moving the carrier 708 may be used. Both of the mechanisms can be controlled by a computer, and the computer may control the relative position of the film forming object 714 with respect to the liquid jet head 1000, timings to eject liquid from the liquid jet head 1000, selection of discharging nozzles and the like, whereby a film can be formed in a desired pattern on the film forming object 714. The shifting mechanisms may be formed with, for example, stepping motors. It is noted that the film forming apparatus 10000 may be equipped with a camera device for monitoring the film forming object during its operation. By so doing, a desired film can be aligned with respect to and laminated over an underlying pattern.

Now, referring to FIG. 15, an example of a control system for the film forming apparatus 10000 is described. In the illustrated example, the film forming apparatus 10000 is controlled by a computer 818. Printing positions and coordinates of printing patterns on a film forming object 714 may be set by the computer 818. Also, commands for changing the relative position of the film forming object 714 with respect to the liquid jet head 1000 can be transmitted from the computer 818 to a shift controlling section 820. Positions of the table and printing positions can be detected and calculated by using the camera device (not shown) fixed on the film forming apparatus 10000, reference position marks formed on the table 714, and position scales in x direction and y direction (not shown). Such positional information is transmitted to the computer 818. Based on the positional information signals, the computer 818 can send trigger pulses to a waveform generator 822. The waveform generator 822 can supply driving pulses through a power amplifier 824 for driving the liquid jet head 1000. The film forming apparatus 10000 is controlled in this manner, whereby films in desired patterns can be formed on the film forming object 714.

The film forming apparatus 10000 in accordance with the present embodiment excels in accuracy in coating droplets on a film forming object as it has the liquid jet heads 1000 described above. More specifically, at the time of forming film patterns, positional deviations of droplets are suppressed, and the accuracy in coating positions is high, as described in conjunction with the other embodiments. Therefore, the film forming apparatus 10000 can be favorably used in the steps of forming color filters in manufacturing liquid crystal displays, plasma displays, organic EL displays and electrophoretic displays, and in the steps of forming light emission layers and driving transistors in desired patterns and the like on substrates. In particular, when the film forming apparatus 10000 in accordance with the present embodiment is used in manufacturing large-sized display devices which may require large displacements in the relative position of the film forming object 714 with respect to the liquid jet head 1000, the effect of suppressing deviations in coating steps can be exhibited more clearly. It is noted that the film forming apparatus 10000 in accordance with the present embodiment can provide generally the same effects even when it has the line type liquid jet head 7000, instead of the liquid jet head 1000 exemplified above.

The invention is not limited to the embodiments described above, and many modifications can be made. For example, the invention may include compositions that are substantially the same as the compositions described in the embodiments (for example, a composition with the same function, method and result, or a composition with the same objects and result). Also, the invention includes compositions in which portions not essential in the compositions described in the embodiments are replaced with others. Also, the invention includes compositions that achieve the same functions and effects or achieve the same objects of those of the compositions described in the embodiments. Furthermore, the invention includes compositions that include publicly known technology added to the compositions described in the embodiments.

What is claimed is:

1. A liquid jet head comprising:

a plurality of unit heads, wherein each of the unit heads has a nozzle forming region and a plurality of nozzle apertures arranged in a first direction in the nozzle forming region, the plurality of unit heads being laminated in a manner that the nozzle forming regions are shifted from one another in a second direction orthogonal to the first direction, wherein the unit heads are laminated in a third direction orthogonal to the first direction and the second direction, liquid is ejected in a fourth direction between the second direction and the third direction, and the nozzle apertures are formed in a manner that center lines of the nozzle apertures are orthogonal to a plane formed by connecting ends of the head units in the second direction.

2. A liquid jet head according to claim 1, wherein the nozzle apertures have center lines that are inclined with respect to the third direction.

3. A liquid jet head according to claim 1, wherein each of the unit heads includes a nozzle plate having a plurality of nozzle apertures arranged along the first direction in the nozzle forming region, a pressure chamber substrate provided above the nozzle plate and having a plurality of pressure chambers communicating with the nozzle apertures, an elastic plate provided above the pressure chamber substrate, a plurality of piezoelectric elements provided above the elastic plate and above the pressure chambers, respectively, each of the piezoelectric elements having a lower electrode, a piezoelectric layer and an upper electrode, and a sealing plate provided above the piezoelectric elements and covering the piezoelectric elements through a space there between.

4. A liquid jet head according to claim 1, wherein the plurality of unit heads eject mutually different liquids.

5. A printer comprising the liquid jet head recited in claim 1.

6. A film forming apparatus comprising the liquid jet head recited in claim 1.

7. A line type liquid jet head comprising:

a plurality of liquid jet heads, each of the liquid jet heads including a plurality of unit heads, each of the unit heads having a nozzle forming region and a plurality of nozzle apertures arranged in a first direction in the nozzle forming region, the plurality of unit heads being laminated in a manner that the nozzle forming regions are shifted from one another in a second direction orthogonal to the first direction, the unit heads are laminated in a third direction orthogonal to the first direction and the second direction, and liquid is ejected in a fourth direction between the second direction and the third direction, wherein the plurality of the liquid jet heads are arranged in a staggered fashion such that the fourth directions are aligned in the same direction, and the liquid jet heads are disposed in a manner that the nozzle forming regions are arranged next to each other.

8. A line type liquid jet head according to claim 7, wherein the plurality of liquid jet heads are arranged in the first direction with overlapping regions provided therein, the nozzle apertures of each of the liquid jet heads are continuously arranged in the first direction in the plurality of liquid jet heads.

9. A line type liquid jet head according to claim 8, wherein the pitch of the nozzle apertures in the entire line type liquid jet heads is constant in the first direction.

10. A line type printer comprising the line type liquid jet head recited in claim 7.

11. A film forming apparatus comprising the line type liquid jet head recited in claim 7.

* * * * *